US005450670A

United States Patent [19]

Sakai

[11] Patent Number: 5,450,670

[45] Date of Patent: Sep. 19, 1995

[54] KNIFE HAVING DETACHABLE HOOK

[75] Inventor: Kimiyuki Sakai, Seki, Japan

[73] Assignee: Gerber Sakai Co., Ltd., Gifu, Japan

[21] Appl. No.: 255,089

[22] Filed: Jun. 7, 1994

[51] Int. Cl.[6] ..... B26B 1/10

[52] U.S. Cl. ..... 30/298.4; 30/155; 30/164; 224/232; D22/118

[58] Field of Search ..... 30/155, 298.4, 231, 30/164; 224/197–198, 226, 232–233, 252; D22/118; D8/4.5

[56] References Cited

FOREIGN PATENT DOCUMENTS 391379 10/1908 France ..... 224/232

26259 12/1904 United Kingdom ..... 224/232

OTHER PUBLICATIONS

Knife Magazine, Apr., 1994, Published by World Photo Press.

*Primary Examiner*—Douglas D. Watts

*Attorney, Agent, or Firm*—Sheridan Ross & McIntosh

[57] ABSTRACT

A knife is provided having a blade, foldably supported by a handle, and a hook for fastening the knife onto another object apart from the knife. A pair of brackets are integrally and flexibly formed with the handle to pivotably attach the base of the hook to the handle. The brackets are given flexibility as a result of being resin-molded integrally with the handle. The hook has a base which is directly attached to the brackets, and a body which is hooked onto an object. Both brackets have a pair of bearing holes lying on the same axis. The base of the hook also has a pair of support shafts which are rotatably fit into both the bearing holes. The hook can then be pivotably attached to both brackets by fitting both support shafts into both bearing holes.

16 Claims, 7 Drawing Sheets

KNIFE HAVING DETACHABLE HOOK

BACKGROUND OF THE INVENTION

1. Field of the Invention

The present invention relates to a knife having a foldable blade. More specifically, the present invention relates to the improvement of the knife's portability and attachability to other objects, such as a belt, other objects of clothing.

2. Description of the Related Art

Of the various types of knives found in the prior art, one type is the common pocket knife. A description of this type of knife is disclosed in, for example, Japanese Unexamined Utility Model Publication No. 52-58600, Japanese Unexamined Utility Model Publication No. 58-84070 and Japanese Unexamined Patent Publication No. 59-44289. In each case, the general construction of the pocket knife is, as shown in FIG. 13, such that a blade 63, extends from a handle 62 and is foldable with respect to the handle 62. When the blade 63 is folded, the size of this knife 61 is relatively compact and portable, with the entire knife 61 being roughly equal is size to that of the handle 62. The knife 61 is usually carried by placing the folded or closed knife 61 in a pocket of a shirt, a pair of pants or similar article of clothing. Alternatively, as shown in FIG. 14, a special-purpose case 65, having a freely opening cover 64, can be attached to a pair of pants 66 or a belt 67 in the vicinity of the user's waist.

With the case 65 attached at the knife user's waist, the location of the case 65 is close to the user's hands (assuming a normal upright posture of the user). Consequently, the knife 61 when placed in the case 65 can be easily be taken out for quick use. Moreover, since the case 65 is worn on the waist, the case 65 tends not to impair the movement of the knife user, thereby improving the portability of the knife 61.

To enjoy this type of portability, however, the case 65 is obviously required as an item separate from the knife 61. Moreover, it is necessary to go to the trouble of wearing the case 65 on the pants 66 or the belt 67. Consequently, it would be desirable to provide a knife having a degree of portability similar to that provided by the case 65 without the inconvenience of either attaching the case 65 to the waist, or even of having a case 65 at all. It would likewise be desirable that such a knife be compact in size, as is characteristic of many pocket knives.

A defining feature of such a knife would be the means for attaching a hook or the like to the pocket knife itself, as well as the means for directly hooking the knife to the person's pants, belt loop or other article of clothing. A further important feature of such a knife would be the ease with which the hook, as a component of the knife, could be manufactured and assembled. Still another important feature would be the ease of removing the hook from the knife.

For example, as with the conventional knife as shown in FIG. 13, the knife's manufacture and assembly requires an relatively precise process for aligning or positioning the hook on the handle. This effectively requires the addition of a step or process in the manufacture and assembly of the conventional pocket knife. Moreover, should the hook of the pocket knife be undetatchable from the knife, and should either the hook or knife component need repair, it is entirely possible that any repair of the hook or knife may damage the attached component. Further, when the hook is damaged and needs repair, it is a major disadvantage to have to disassemble if the knife body in order to repair the hook. It is consequently desirable in terms of manufacturing and repair that the knife body be detachable from the hook.

SUMMARY OF THE INVENTION

Thus, the main object of the present invention is premised on obtaining a pocket knife which is easily portable, unobtrusive during its portage and which is equipped with means for fastening such as a hook or the like to allow the knife to be quickly attatched and unattached from an article of clothing or the like. In addition, the object of the present invention is to provide a knife whose manufacture and repair is simplified and improved by providing a hooking means detachable form the knife body.

In order to achieve the above-mentioned object, the knife of the present invention is equipped with a blade foldably supported by a handle. This knife is formed separately from the handle, and is equipped with a hook for hooking on other objects. A bracket is provided on the handle that attaches to the base of the hook and that allows the hook to swivel and be removed from the knife.

Objects of the invention other than that described above are clear based on an understanding of the embodiments of the present invention described hereinbelow, and are clearly indicated in the appended claims. Moreover, the large number of advantages not mentioned in this specification would most likely be conceived of by those skilled in the art when the present invention is carried out.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
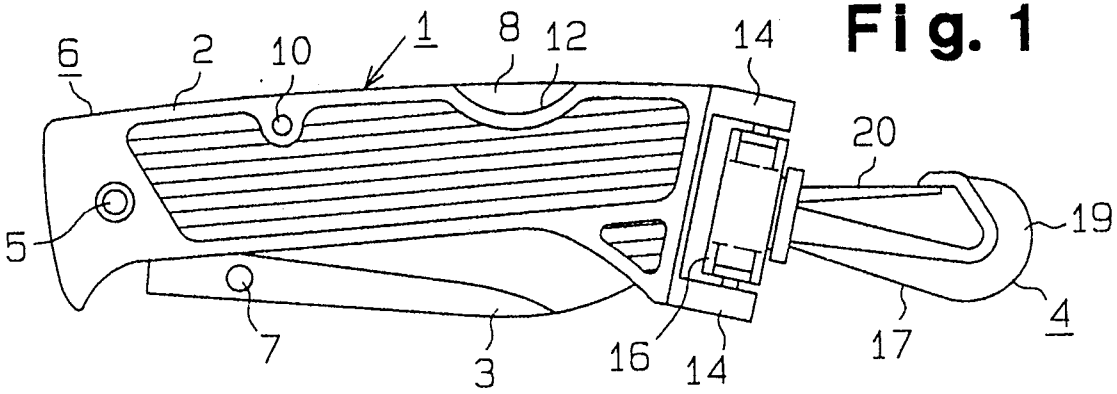
FIG. 1 shows a knife according to a first embodiment of the present invention, with its blade in the folded or closed position.

An embodiment which embodies the present invention will be described below in detail referring to the drawings.

Figure 2:
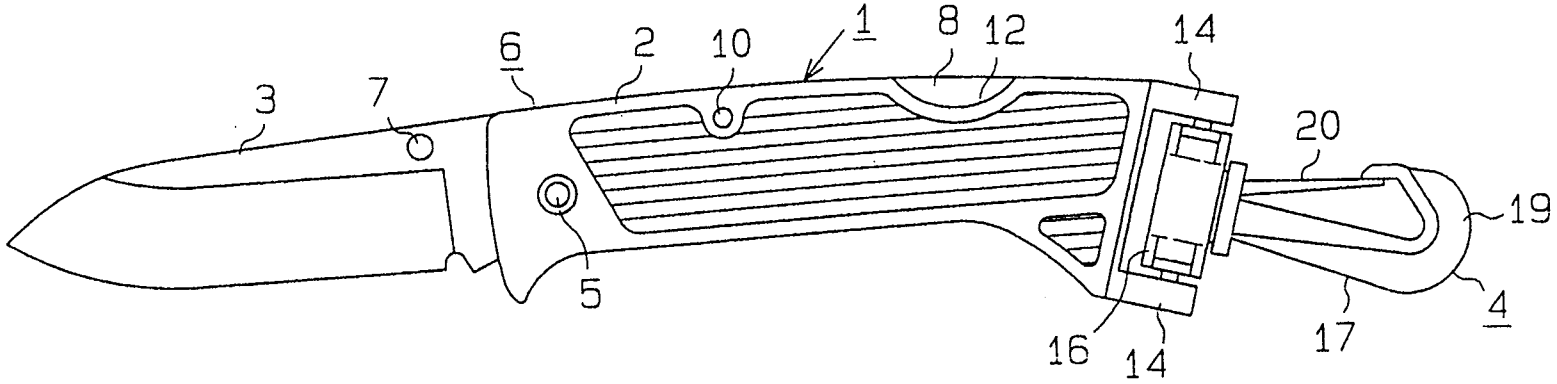
FIG. 2 shows the knife of FIG. 1 having its blade in an unfolded or open position.

As shown in FIGS. 1 and 2, a knife 1 of the present embodiment is composed of a handle 2, made of plastic, used as a side gripping surfaces 27 formed on opposite sides of the knife handle 2, a blade 3, made of metal, and a hook 4, made of plastic. The blade 3 is foldably supported centering on a pin 5 at a distal end of the handle 2. The hook 4 is attached to a proximal end of the handle 2. The portion of knife 1 excluding hook 4 is a knife body 6 formed separately from the hook 4.

Figure 3:
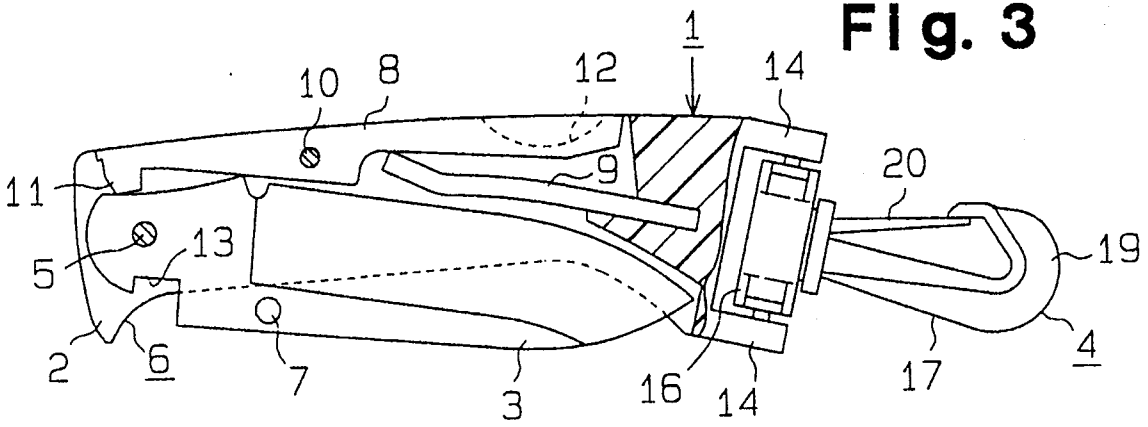
FIG. 3 shows the knife of FIG. 1 with a portion cut thereof away.

As shown in FIG. 2, the blade 3 is opened and extends from the handle 2 to a tip portion 25 of the cutting edge of the blade 3 when the knife 1 is to be used. On the other hand, when the knife 1 is unused, the blade 3 pivots on a pin 5 in a direction toward the handle 2 from the state shown in FIG. 2. The blade 3 as a result of this pivoting folds into a slot 29 formed between the side gripping surfaces 27 of the handle 2 as shown in FIG. 3. A blade receiving surface 71 defines the surface of the handle 2 which the knife blade 3 folds into. A back side surface 23 of the handle 2 is defined on the side of the handle, opposite the folded blade 3. This allows for a compact sized the knife body 6 roughly equal in size to that of the handle 2, as shown in FIG. 1. A butt end surface 69 of the knife 1 is defined by the perimeter of the back side surface 23, the gripping surfaces 27, and the blade receiving surface 71.

An operating pin 7 is provided protruding from the blade 3. This operating pin 7 is manipulated with the fingers during pivot of the blade 3. Thus, when grasping the handle 2 with one hand, the blade 3 can be unfolded easily by manipulating the operating pin 7 with the thumb.

Figure 4:
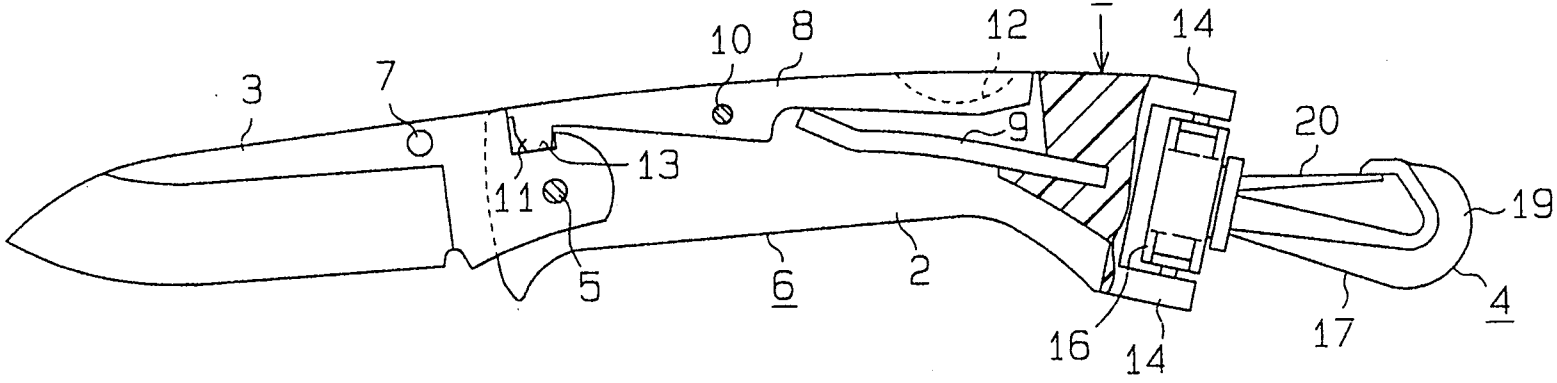
FIG. 4 shows the knife of FIG. 2 with a portion cut thereof away.

The blade 3 is firmly held in the unfolded state and folded state by the holding mechanism is shown in FIGS. 3 and 4. This holding mechanism is equipped with a back metal 8 that extends along a back side surface 23 of the handle 2, and a leaf spring 9 provided within the handle 2. The back metal 8 has a long shape with its center pivotably attached by a pin 10 to the handle 2. The back metal 8 has a projection 11, which engages with the base end of blade 3, on its end. Moreover, the handle 2 has a notch 12 in its back. A portion of back metal 8 can be pushed down with the finger in this notch 12. The base end of leaf spring 9 is mounted on the handle 2, while its leading end engages with the base end of back metal 8. The back metal 8 is urged to pivot in the counter-clockwise direction of FIGS. 3 and 4. This pivoting action is accomplished by manipulating the leaf spring 9 in this engaged state. The blade 3 has a notch 13 in its base end able to engage with the projection 11.

In the folded state shown in FIGS. 1 and 3, pressure is applied to the base end of blade 3 as a result of base end's engagement with the projection 11 of back metal 8. As a result of this pressure, the blade 3 is held in the folded state. On the other hand, in the unfolded state shown in FIGS. 2 and 4, the notch 13 of blade 3 engages with the projection 11 of the back metal 8. As a result of this engagement, pivoting action of the unfolded blade 3 is restricted. In order to fold an open or unfolded the blade 3, the engagement between the projection 11 and the notch 13 is released by pushing down on the back metal 8 with the finger at the notch 12 of handle 2.

A hook 4 is provided on the handle 2 in order to hook onto an object. In order to removably attach the hook 4 to the handle 2, a pair of cantilevered brackets 14 are formed on the butt end surface of handle 2. In this embodiment, both brackets 14 are molded from plastic into a single structure with the handle 2. Since they are made of plastic, both brackets 14 are given a certain degree of flexibility. Both brackets 14 project longitudinally from the butt end of the handle 2. The overall width of the brackets 14, however, does not exceed the width defined by the distance separating the back end surface 23 and the blade receiving surface 71. That is, the outer surface of one of the brackets 14 is according to this embodiment, coterminous with the back side and side gripping surfaces, while the other bracket is, coterminous with the blade receiving and side gripping surfaces. The brackets 14, thus, do not extend laterally beyond the perimeter of the butt end surface, defined on two sides by the side gripping surfaces 27 and on the other sides by the back side surface 23 and blade receiving surface 71. Neither bracket extends beyond the perimeter of the butt end surface 69, the back side surface 23 and the two side gripping surfaces 27. All four surfaces 69, 23, and the two surfaces 27 can be considered in total as one handle gripping surface.

Figure 5:
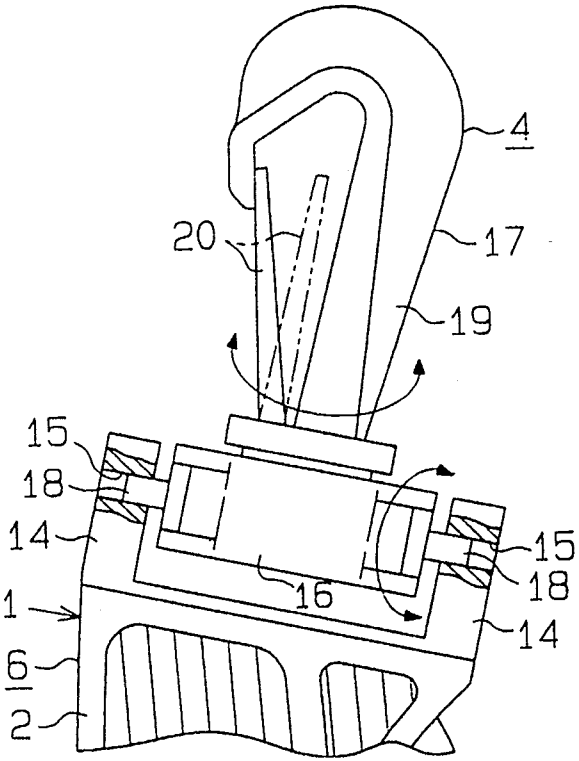
FIG. 5 shows an enlarged view of the hook of the knife of this embodiment.

As shown in FIG. 5, both brackets 14 have a pair of bearing holes 15 located on the same central axis. The hook 4 is composed of a base 16, which is directly attached between both brackets 14, and a body 17, which is hooked onto another object. The base 16 has a pair of support shafts 18 lying on the same axis formed into a single structure with the base 16. Both support shafts 18 are rotatably attached to both bearing holes 15. Here, the body 17 has a J-shaped piece 19 and a closing piece 20 which closes the open end of this J-shaped piece 19. The closing piece 20 is flexible and allows the open end of the J-shaped piece 19 to be closed with a distal end of the closing piece 20. The open end of J-shaped piece 19 is opened by bending the closing piece 20 with pressure applied by the finger. This body 17 is assembled so as to be able to pivot with respect to the base 16. According to this embodiment, the brackets 14 and base 16 may be understood as a coupler 72 formed having two parts, one part corresponding to the base 16 and the other part corresponding to the brackets 14.

Thus, in the state where the hook 4 is attached to both brackets 14, the hook 4 is able to pivot with respect to the brackets 14 due to the relationship between both support shafts 18 and both bearing holes 15. The body 17 of hook 4 is able to rotate with respect to the base 16. Moreover, the direction of rotation of body 17 is perpendicular to the direction of rotation of hook 4 with respect to the brackets 14. Consequently, the knife body 6 is able to rotate freely in two different directions with respect to the fixed hook 4.

Figure 6:
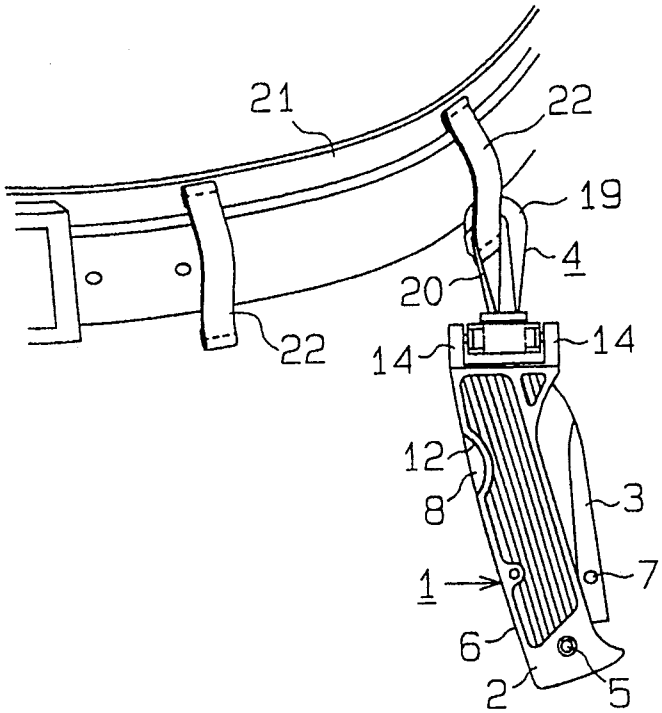
FIG. 6 shows the knife of this embodiment hooked to a belt loop for easy carrying.

In order to carry the knife 1 composed in the manner described above, its hook 4 is directly hooked onto a belt loop 22 of pants 21 and hung down from the waist in the state in which the knife body 6 is folded as shown in FIG. 6. In this case, the hook 4 can be easily removed from the belt loop 22 by manipulating the closing piece 20 of hook 4 with the finger. In this suspended state, since the knife 1 is located near the position of the user's hands the given a normal upright posture, the knife 1 can be removed quickly and easily. As a result, the knife 1 can be promptly provided for use when necessary.

Moreover, since the knife 1 is worn on the waist, the knife 1 itself will not hinder the person's movement. This improves the portability of the knife 1. In addition, when the knife 1 is worn on the waist, any swinging motion of the knife 1 caused by the user's moving waist can be minimized. This is due to the ability of the knife body 6 to freely pivot in two different directions with respect to the hook 4. Consequently, the knife 1 can be made to conform to the movement of the waist, thereby reducing the feeling hampering and burdensome wearing the knife 1.

In order to manufacture the above-mentioned knife 1, the knife body 6 and the hook 4 are individually made in advance. The knife body 6 is made by sequentially assembling the blade 3, the back metal 8 and the leaf spring 9 and so forth to the handle 2 molded from a resin. The hook 4 is made by assembling the body 17, which is molded from a resin, to the base 16. After completion of fabrication of the above parts, the hook 4 should be attached to the knife body 6.

Figure 7:
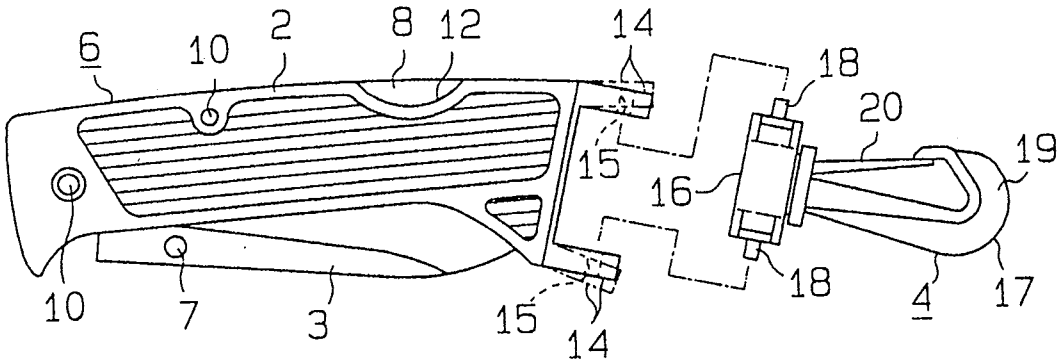
FIG. 7 shows the deformable bracket means allowing the knife body to be detached from the hook.

In order to attach the hook 4 to the knife body 6, as shown in FIG. 7, both brackets 14 are suitably pushed apart using an appropriate jig. At this time, both brackets 14 are able to be spread apart or deformed based on their own flexibility.

Consequently, the hook 4 is fit between both brackets 14 that have been spread apart. At this time, both support shafts 18 of hook 4 are engaged in both bearing holes 15 of both brackets 14. After removing the above-mentioned jig from both brackets 14, the attachment of the hook 4 to the knife body 6 and the manufacturing of the knife 1 is complete.

Thus, in knife 1 of the present embodiment, the hook 4 can be easily attached to the knife body 6 at the time of its manufacturing. In this attached state, since both support shafts 18 are engaged in both bearing holes 15, the hook 4 can be securely attached to the brackets 14, preventing hook 4 from being disengaged from the brackets 14.

Moreover, in terms of making the knife body 6 and the hook 4 individually, the knife 1 can be manufactured by assembling both knife body 6 and hook 4. Consequently, the process for making the knife body 6 and for attaching the hook 4 to the knife body 6 can be performed separately. Therefore, there is no need to carry out the additional processes of attaching the hook 4 to the knife body 6 during the course of the manufacturing the knife body 6. Thus, manufacturing of knife body 6 need not be hindered by attachment of the hook 4. This allows for a smooth and flexible knife assembly procedure.

In addition to the above described manufacturing advantages, the knife 1 according to the present embodiment, presents advantages to a user when repair of the knife 1 is needed. Namely, during the repair of the knife 1, the knife body 6 and the hook 4 can be handled separately.

Should the hook 4 happen to become damaged and require replacement, the hook 4 can be removed from both brackets 14 following the inverse procedure of that performed during manufacturing. A new hook 4 is then attached to both brackets 14 in place of the damaged hook 4. In this manner, even when the hook 4 breaks, it can easily be replaced with a new hook 4 without the user having to disassemble the knife body 6. This detachability consequently promotes the longevity of the knife.

Alternatively, should the knife body 6 happen to become damaged, the hook 4 can be detached from both brackets 14 in a similar manner as described above to perform its repair. The knife body 6 can then be repaired with the hook 4 removed. Consequently, the hook 4 will not hinder any repair work needed to be done to the knife body 6. Should repair work to knife body 6 be needed, damage to hook a can likewise be prevented not damaged during the course of repair work.

In addition, since both handle 2 and the hook 4 are formed of a resin, a sense of uniformity and improvement in design results from the appearance of the knife 1.

Although only one embodiment of the present invention has been described herein, it should be apparent to those skilled in the art that the present invention may be embodied in many other specific forms without departing from the spirit or scope of the invention. Particularly it should be understood that the present invention may also be embodied in a different form like that described below.

Figure 8:
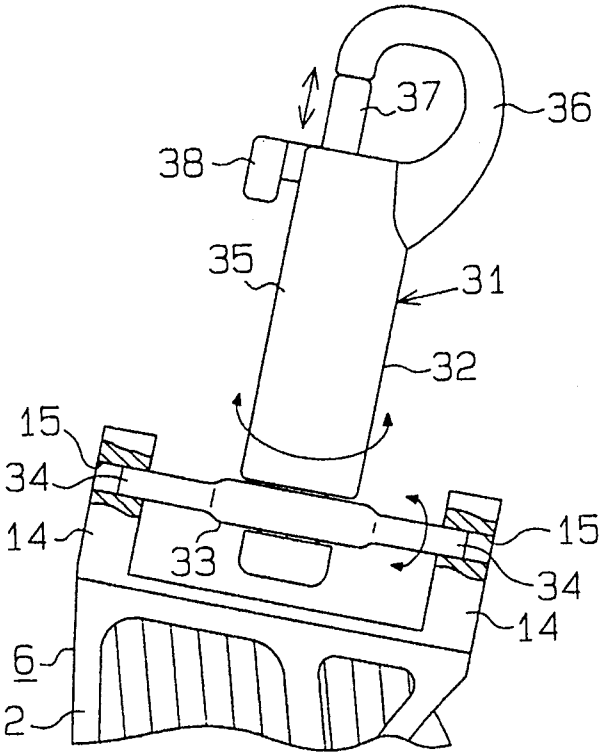
FIG. 8 is another embodiment of the present invention showing a variation of the hook.

A different type of hook 31 is shown in FIG. 8. Here, only the hook 31 is different, while other components are the same as those of the previous embodiment. This hook 31 is made of metal, and has a body 32 and a base 33. The body 32 is pivotably assembled relative to the base 33. The base 32 also has a pair of support shafts 34 on both its ends able to engage in both bearing holes 15 of both brackets 14. The base 32 has a cylinder 35 and J-shaped piece 36 extending from its cylinder 35. A rod-shaped closing piece 37, which closes the open end of J-shaped piece 36, is provided in the cylinder 35. This closing piece 37 is forced in the direction of closing of the open end of J-shaped piece 36 by a spring (not shown) housed in the cylinder 35. This closing piece 37 is able to move in opposition to the force of the spring by manipulation of lever 38. The open end of J-shaped piece 36 is opened as a result of this movement.

In this embodiment as in previous embodiments, the hook 31 can be attached to and removed from both brackets 14 by pushing apart both brackets 14.

Figure 9:
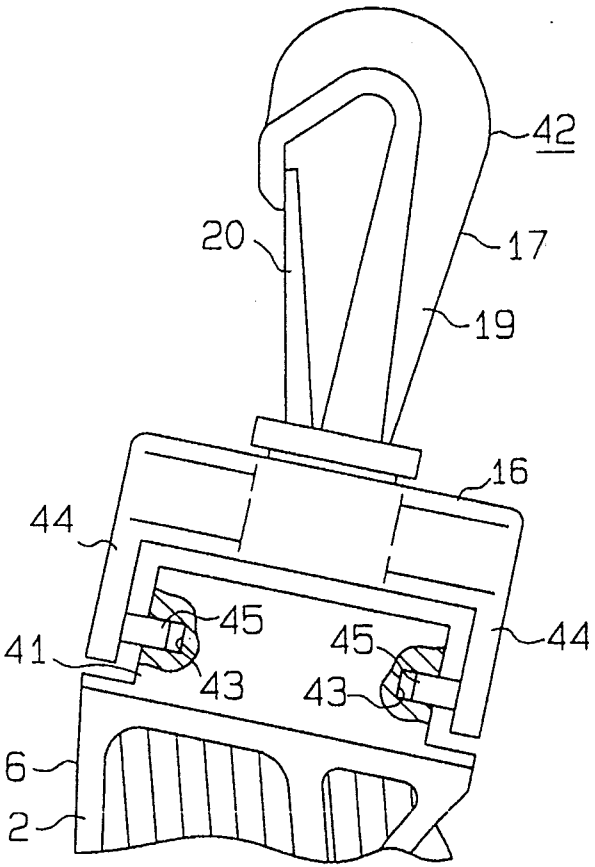
FIG. 9 is another embodiment of the present invention showing a variation of the hook and bracket.

A different type of 2 part coupler 72 is shown in FIG. 9. One part of the coupler corresponds to the bracket 41 is formed into a single structure with the handle 2. The horizontal width of this bracket 41 is slightly smaller than that of the handle 2. The bracket 41 has a pair of bearing holes 43 lying on the same axis in both of the side walls. On the other hand, although the hook 42 resembles previously described hook 4, one part of the coupler 72, i.e., its base 16 is of a structure which is able to conform to the bracket 41. Namely, the base 16 has a pair of arms 44 extending downward on both sides, and a pair of support shafts 45 able to engage in both bearing holes 43 to the inside of those arms 44. The cantilevered arms 44 can be made flexible to deform toward and apart from each other.

In this constitution, flexibility is given to both arms 44. The hook 42 can then be attached to or removed from the bracket 41 by deforming and spreading apart both arms 44. Consequently, since flexibility is given to both arms 44, the handle 2, including the bracket 41, can be formed of a material such as metal having relatively no flexibility.

Figure 10:
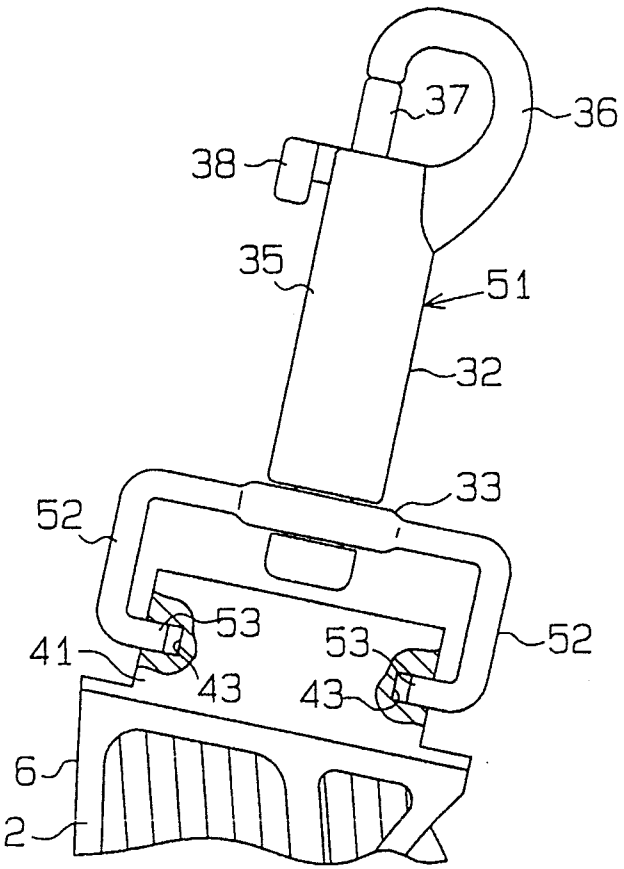
FIG. 10 is still another embodiment of the present invention showing a variation of the hook and bracket.

A variation of the above-mentioned hook 31 capable of conforming to the above-mentioned bracket 41 is shown in FIG. 10. This hook 51 unlike the hook 31 illustrated in FIG. 8, has both sides of base 33 formed as bent portions 52. The ends of both bent portions 52 serve as a pair of support shafts 53 that can engage in both bearing holes 43 of bracket 41. Since the bent portions 52 are relatively flexible, the hook 51 can be attached to and removed from the bracket 41 by spreading apart both bent portions 52. The flexibility of these bent portions 52 require, however, that only the base 33 of hook 51 may be formed of a resin.

Figure 11:
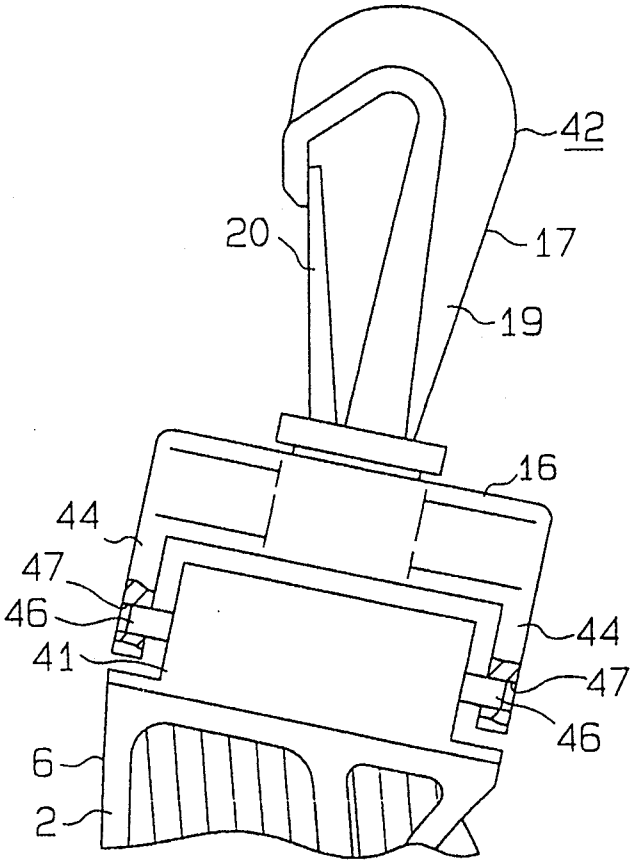
FIG. 11 is a further embodiment of the present invention showing a variation of the hook and bracket.
Figure 13:
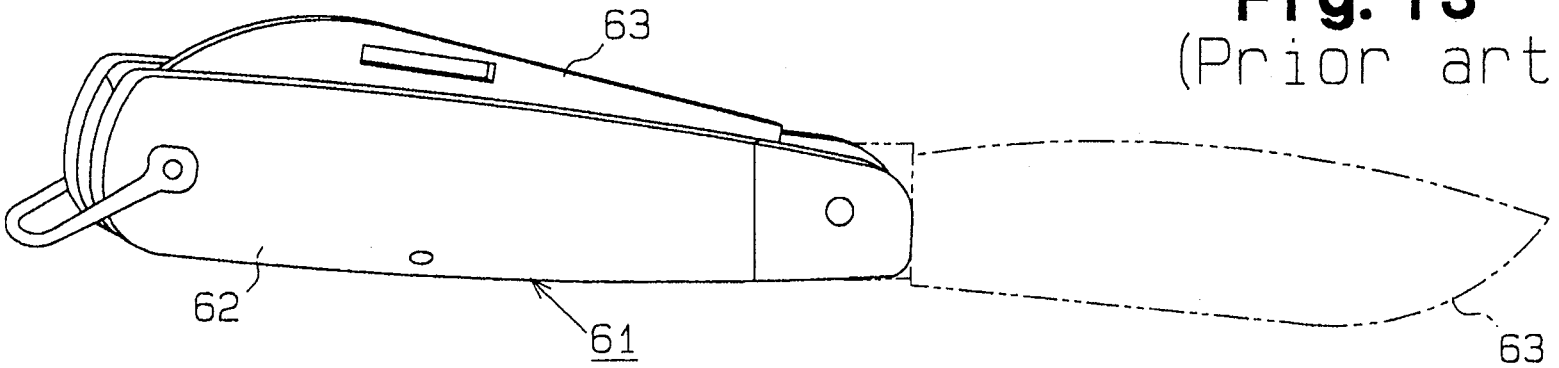
Fig. 13 (Prior art)
FIG. 13 indicates a knife of prior art design.
Figure 14:
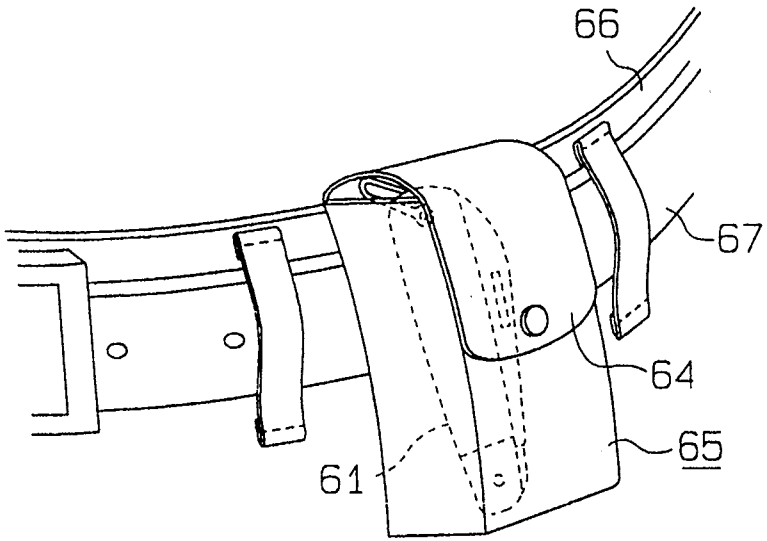
Fig. 14 (Prior art)
FIG. 14 indicates a knife of prior art design in a carrying case.

FIG. 11 shows a variation of the hook 42 and bracket 41 illustrated in FIG. 9. The bracket 41 of FIG.11 has a pair of support shafts 46 lying on the same axis on both of the side walls. The hook 42 alternatively has a pair of bearing holes 47 able to engage with both the support shafts 46 on the inside of both arms 44. In this embodiment as well as with the embodiment show in FIG. 11, the hook 42 can be attached to or removed from the bracket 41 by spreading apart both arms 44.

Figure 12:
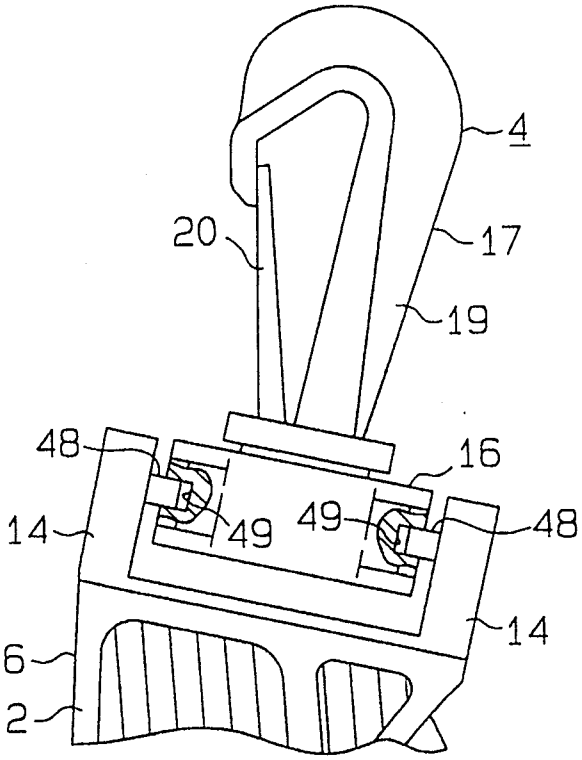
FIG. 12 is yet another embodiment of the present invention showing a variation of the hook and bracket.

FIG. 12 shows a variation of the hook 4 and bracket 14 shown in FIG. 5. Both brackets 14 of FIG. 12 have a pair of support shafts 48 lying on the same axis and extending toward each other on the inside. The the base 16 of hook 4 has a pair of bearing holes 49 engageable with both support shafts 48 on both of its ends.

In this embodiment as well as that show in FIG. 5, the hook 4 can be attached to or removed from both brackets 14 by spreading apart both brackets 14.

Therefore, the present examples and embodiments are to be considered as illustrative and not restrictive, and the invention is not to be limited to the details given herein, but may be modified within the scope of the appended claims.

What is claimed is:

1. A knife having a blade foldably supported by a handle, said knife comprising:

a hook having a base pivotally attached to a body shaped such that said body can detachably fasten the knife to an object; and a pair of flexible brackets projecting from an end of said handle for detachably securing the base of said hook to the handle wherein at least one of said bracket and base of said knife comprises a pair of bearing holes aligned on an axis while the other one of said bracket and base has a pair of support shafts adapted to fit in said bearing holes.

2. The knife as set forth in claim 1, wherein said hook comprises a J-shaped body rotably attached to the base of the hook.

3. The knife according to claim 1, wherein the outer surfaces of the brackets form extensions of the knife handle.

4. The knife according to claim 1, wherein the brackets comprise a pari of cantilevered members.

5. The knife according to claim 4, wherein the support shafts are formed on the hook base, the bearing holes are formed in the cantilevered members, and wherein the cantilevered members are adapted to flex in opposite directions, away from each other, to permit the support shafts to engage and disengage the bearings holes.

6. A knife having a foldable blade, a first end portion of which forms a cutting tip and the second end portion of which is pivotally attached to said knife, said knife comprising:

a hook for fastening the knife to an object;

a handle for providing gripping surfaces to said knife, said handle including:

two side gripping surfaces;

a blade receiving surface having a slot formed therein to receive the cutting edge of said blade;

a back side surface;

a butt end surface at a tip end of the handle, said butt end surface having a perimeter defined by said side gripping surfaces, the blade receiving surface and the back side surface of the knife handle; and a pair of deformable brackets integrally formed with said handle for attaching the hook to the knife, said brackets longitudinally projecting from the butt end surface without laterally extending beyond the perimeter of said butt end surface.

7. The knife according to claim 6, wherein the outer surfaces of the brackets form extensions of the knife handle.

8. The knife according to claim 6, wherein the brackets comprise a pair of cantilevered members.

9. The knife according to claim 8, wherein the cantilevered members are adapted to flex in opposite directions, away from each other, to permit the hook to engage and disengage said knife handle.

10. The knife according to claim 6 wherein the brackets do not extend beyond the perimeter of the butt end surface.

11. A knife comprising:

a blade;

a handle attached at one end of said blade, said handle having a gripping surface and a butt end surface at an end opposite the blade;

a coupler attached to the butt end surface, said coupler having first and second parts releasably connected together, one of said parts having two cantilevered members flexible toward and away from each other, the other part having a structure cooperative with said first part to engage and disengage the cantilevered members from said second part.

12. The knife as set forth in claim 11, wherein said coupler further comprises a hoop attached to one of the parts.

13. The knife as set forth in claim 11, wherein said cantilevered members extend from the handle's butt end surface without projecting beyond the periphery of the said butt end surface.

14. The knife as set forth in claim 11, wherein on of said parts is molded to the handle.

15. The knife as set forth in claim 11, wherein said hook comprises a base and a J-shaped body rotably attached to the base, said body having a closing member urgable in a closed clasping position against said J-shaped body.

16. The knife as set forth in claim 11, wherein said one of said parts has a pair of bearing holes aligned on an axis for pivotably receiving a pair of support shafts formed on the other one of said parts, whereby said hook pivotably attaches to said knife.

* * * * *